United States Patent [19]

Johnson

[11] 4,129,163

[45] Dec. 12, 1978

[54] PANEL ASSEMBLY AND COMPONENTS THEREOF

[75] Inventor: Bernard L. Johnson, Bellevue, Wash.

[73] Assignee: The Haws Corporation, Elkhart, Ind.

[21] Appl. No.: 614,262

[22] Filed: Sep. 17, 1975

[51] Int. Cl.[2] ..... A47G 5/00

[52] U.S. Cl. ..... 160/135; 160/351; 52/239; 403/49

[58] Field of Search ..... 160/135, 351; 52/239; 108/101; 16/136, 171; 182/178; 403/49; 40/125 H

[56] References Cited

U.S. PATENT DOCUMENTS

| | | | |
|---|---|---|---|
| 801,232 | 10/1905 | Foss | 16/136 |
| 3,599,275 | 8/1971 | Granzow | 16/136 |
| 3,605,851 | 9/1971 | Miles et al. | 160/135 |
| 3,768,222 | 10/1973 | Birum, Jr. | 160/135 X |
| 3,809,142 | 5/1974 | Bleeker | 160/135 |
| 3,841,042 | 10/1974 | Siegal | 52/239 |
| 3,895,670 | 7/1975 | Bales et al. | 160/351 X |

*Primary Examiner*—Philip C. Kannan

*Attorney, Agent, or Firm*—Gordon W. Hueschen

[57] ABSTRACT

A panel assembly which comprises panels having astragals adapted to be attached to the segments of a segmented column and adapted to be rotated about the axis of the column to a position in which one panel forms an angle with another. One or more additional panels may be added to the column. The panels have load supporting means and the column does not.

44 Claims, 9 Drawing Figures

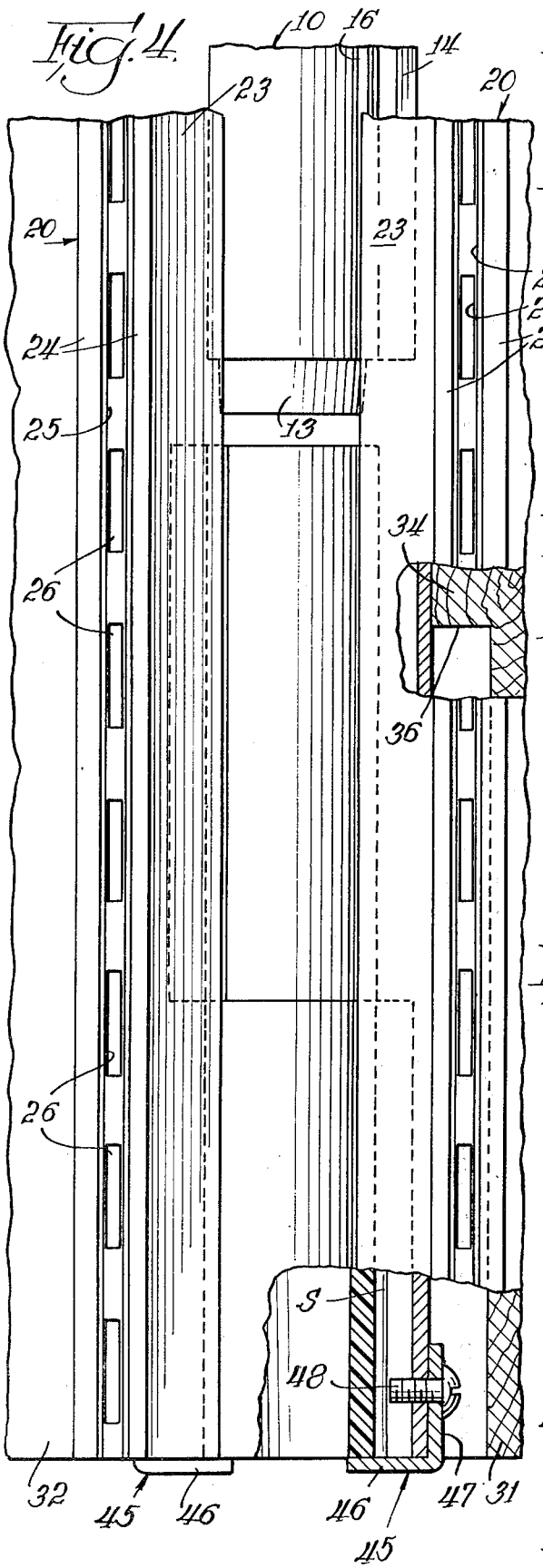
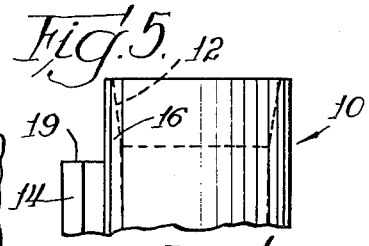
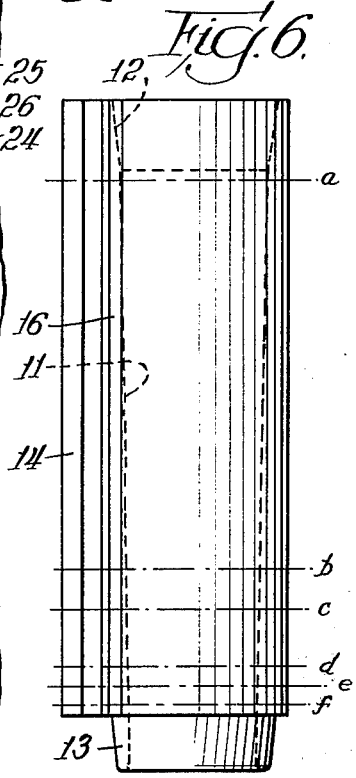
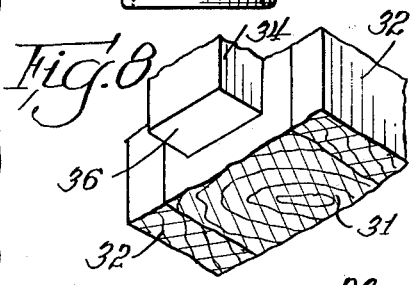
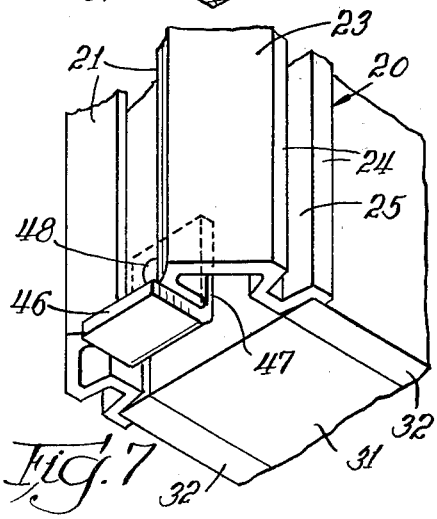
Fig. 7
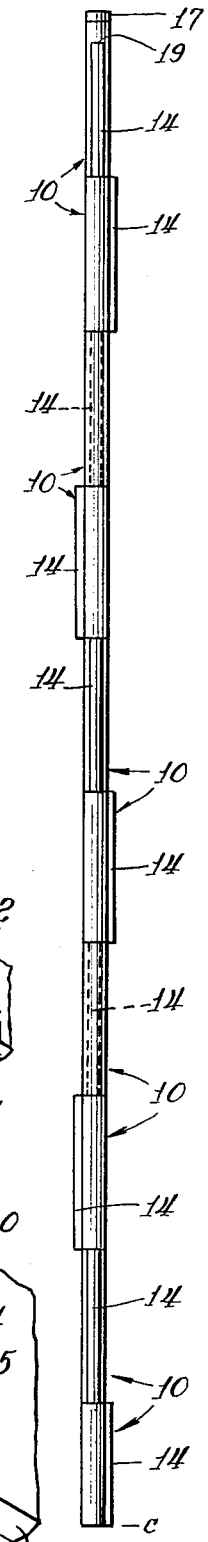

PANEL ASSEMBLY AND COMPONENTS THEREOF

BACKGROUND OF THE INVENTION

1. Field of Invention

This invention relates to panel assemblies suitable for use as room dividers.

2. Prior Art

Panel assemblies adapted for use as room dividers are well known in the art. Such panel assemblies usually comprise panels having astragals on the end thereof adapted to be connected to supporting columns, such, for example, as are found in U.S. Pat. Nos. 3,605,851; 3,762,116; 3,766,692; 3,809,142; and 3,841,042. The panel assemblies of the patents are all characterized in that the columns are load supporting and are distinctly exposed even when as many as 4 panels are attached to a single column.

OBJECTS OF THE INVENTION

It is an object of the invention to provide a new and improved panel assembly. It is a further object of the invention to provide a panel assembly in which the panels are easily removed and additional panels easily added. It is a further object of the invention to provide a panel assembly in which the columns are not load supporting but the panels are. It is a still further object of the invention to provide panel assemblies in which, especially when a full complement of panels is used, the column is hidden. These and other objects will appear as the description proceeds.

SUMMARY OF THE INVENTION

The invention relates to a panel assembly in which the column is made up of a segmented column in which the segments are free to rotate with respect to each other and panels which are attached to different segments of the column. Particularly it is directed to panel assemblies in which each segment carries a panel-connecting means and each panel carries a segment connecting means which panel-connecting means and segment connecting means are complementary one to the other. Still more particularly the invention embodies a column made up of hollow cylinders, each one of which has a female taper at one end and a complementary male taper at the other end. Still more particularly the invention relates to such an assembly in which the panel-connecting means is a T-shaped member extending longitudinally of the column with the "T" of the T-shaped member attached to an element of a segment of the column and the segment connecting means is a complementary undercut T-shaped slot adapted to slide over the T-shaped member. Still more particularly the invention relates to such an assembly in which the astragal has an arcuate or concave portion conforming to the curvature of the column and subtending an angle of 360/X° where X is a small integer of at least 2 and having portions extending out radially from the edges of the said arcuate portion and forming an angle between them of 360/X°, whereby up to X panels can be attached to said column and when only two panels are attached, one can be rotated with respect to the other through an angle of 360 (1−2/X) degrees, so that when X panels are attached to the column, a side portion of one panel will abut a side portion of another and the column will be substantially covered and concealed. Still more particularly the invention comprises such an assembly in which there are bridging portions extending backwardly from the side portions to the sides of the panel, which bridging portions advantageously may have fixture-supporting means incorporated therein, such as a vertical or longitudinal channel having at the bottom slots adapted to receive complementary fixture-supporting supports.

BRIEF DESCRIPTION OF THE DRAWINGS

In The Drawings

FIG. 4 is a fragmentary side view of a panel assembly having two panels attached to the column and in which one of the segments is partially removed from its complementary segment.

FIG. 5 is a fragmentary side view of the topmost portion of the top segment of the column.

FIG. 6 is a side view of a segment of the column.

FIG. 7 is a partial view in isometric projection showing the bottom of the panel with the astragal attached thereto.

FIG. 8 is a fragmentary view of a bottom portion of the end of a panel.

FIG. 9 is a diagrammatical view of the column as the segments would be arranged to receive 4 panels.

DETAILED DESCRIPTION OF THE INVENTION

Figure 1:
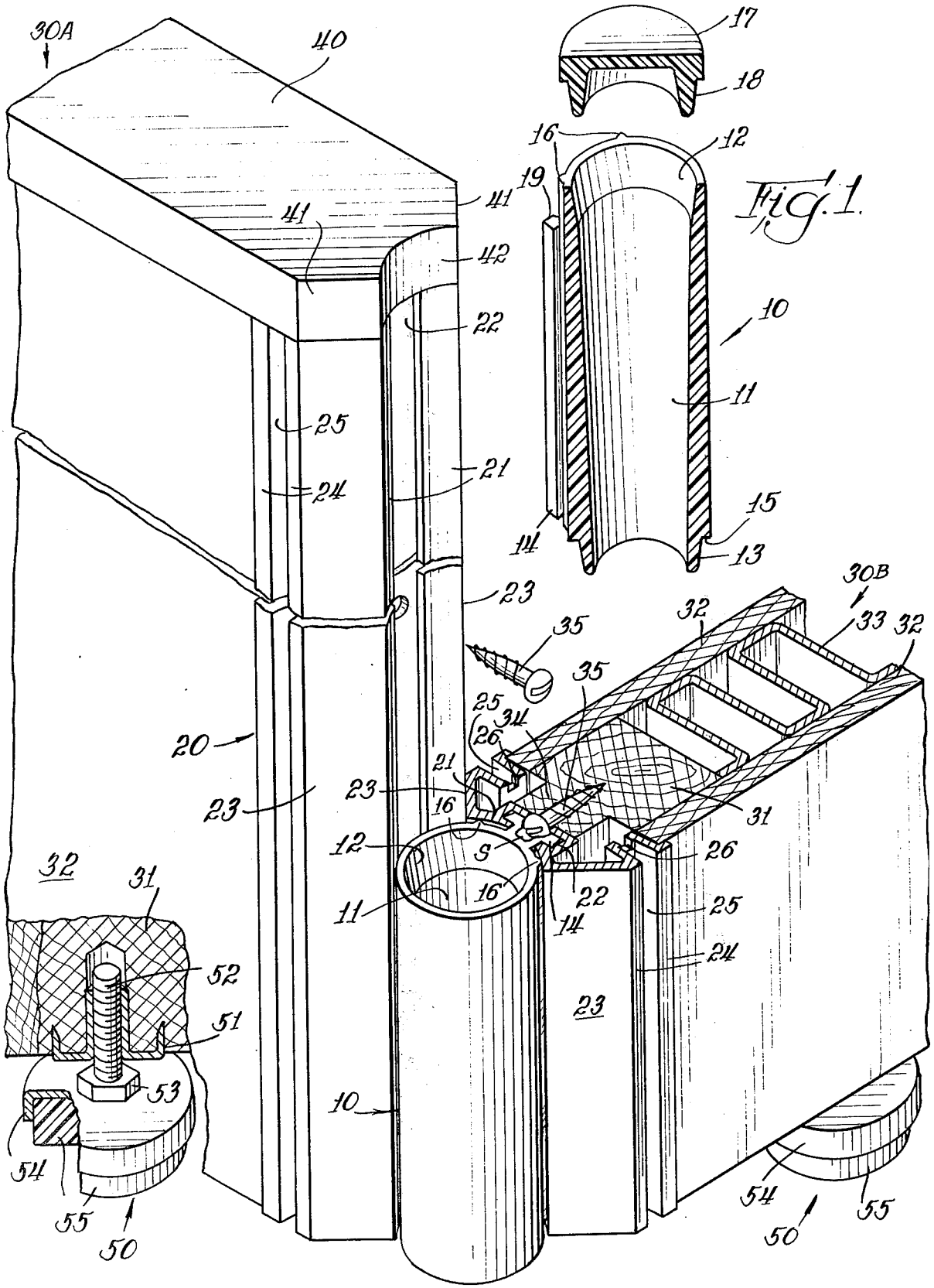
FIG. 1 is an isometric view of the panel assembly with parts broken away and in section. It is partially exploded to show details of construction.

The panel assembly according to the invention consists of a segmented column or panel connector 10, astragals 20, and panels 30. The segments 11 of the column have a female taper 12 and a complementary male taper 13 so that one segment can be inserted into another segment and rotated one with respect to the other. Adjacent the male taper is a shoulder 15 adapted to abut the other end of the segment into which the male taper 13 is inserted. The inside of the segment 11, advantageously, is tapered so that the thickness of the wall at the shoulder 15, that is, at the beginning of the male taper, is the same as the thickness at the beginning of the female taper.

The angle of the male-female taper is not critical but, advantageously, is a small angle, say between about 10 and 20 degrees. The angle of taper of the inside of the segment 11 is inherently smaller than the angle of taper of the male and female tapers and is determined essentially by the length of the segment. Ordinarily it will be approximately one-half of the angle of the taper of the male and female members.

Each segment is provided with a panel-connecting means 14 which, advantageously, is T-shaped with the stem of the T attached to the segment along an element thereof and the astragal 20 has a complementary segment connecting means 22 which is an undercut slot having a complementary T-shape so that the T-shaped panel-connecting means 14 can be slid into the segment connecting means 22.

A cap 17 may be provided for the top of the segmented column 10 which has a depending skirt 18 having a male taper corresponding to the female taper 12.

The astragal has an arcuate or concave portion 21 conforming to the curvature of the segmented column 10. It also has sides 23 extending radially outward from the edges of the arcuate portion 21 and bridging portions 24 adapted to bridge the edges of the sides 23 and the edges of the panels 30. The bridging portion 24 has a longitudinal channel 25 at the bottom of which are slots 26 adapted to hold standard brackets for fixture support.

Figure 2:
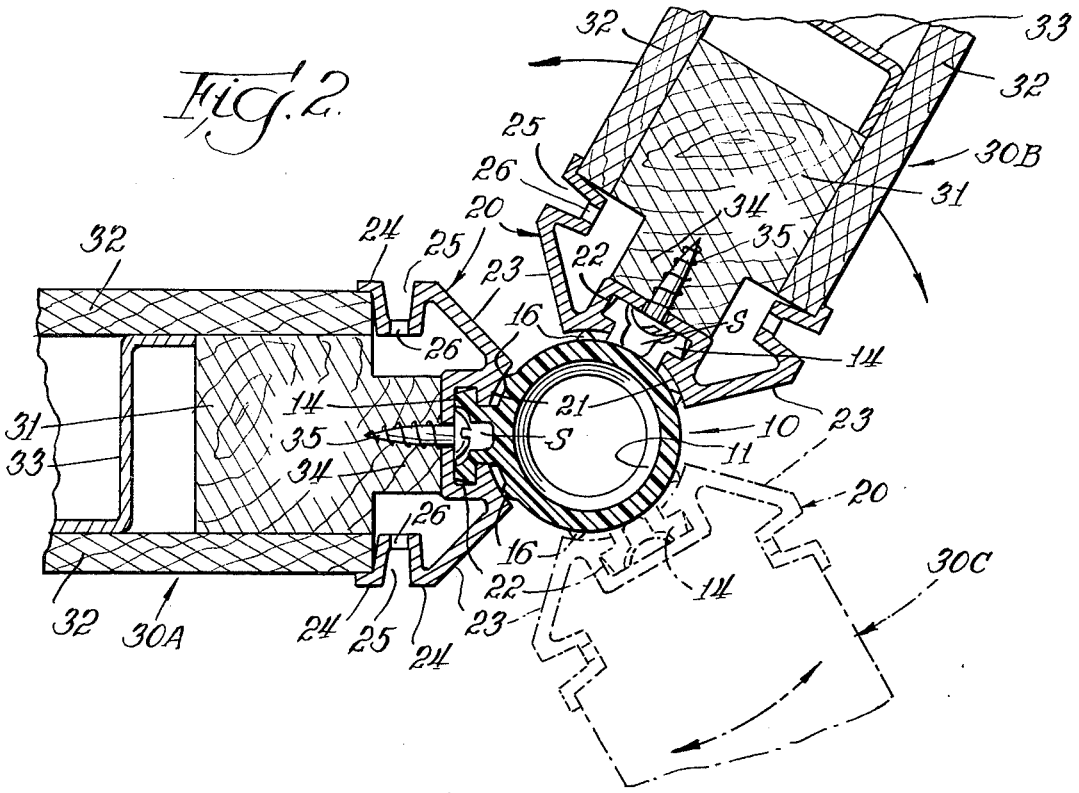
FIG. 2 is a plan view in cross section showing attachment of the panels to the column.

The panel 30 is suitably made of sidewalls 32 attached to an end stud 31 and a corrugated spacer 33. The stud 31 has a tongue 34 projecting beyond the edges of the sides 32 a distance such that when the astragal is abutted against the tongue, the bridging portion 24 sits snugly up against the sides 32. If desired, the bridging portion may either abut or overlap the sides 32. The astragal is attached to the tongue by means of screws 35 and the T-shaped member 14 has a longitudinal channel S adapted to accommodate the head of the screws 35 as best seen in FIG. 2.

The tongue 34 is cut off near the bottom of the panel as seen in FIGS. 4 and 8 to leave space between the astragal and the stud 31 for a purpose to be described.

The panel 30 has a removable top 40 having end faces 41 and 42 corresponding to the sides 23 and the arcuate portion 21 of the astragal 20. When the top 40 is removed the channel 22 is made accessible so that one or more segments 10 can be affixed thereto by inserting the T-shaped member 14 in the channel shaped member 22. A suitable stop 45 is provided to prevent the segment from going below the bottom of the panel. The stop 45 is an angle piece having a bottom 46 and a side 47 which latter is attached through the back wall of the channel 22 of at least one astragal 20 by means of a suitable fastener such as the bolt 48. The bolt 48 should not project far enough into the slot to act as a stop, otherwise a portion of the T-shaped member 14 may have to be cut off as needed to allow the bottom segment to seat on the support 46.

Figure 3:
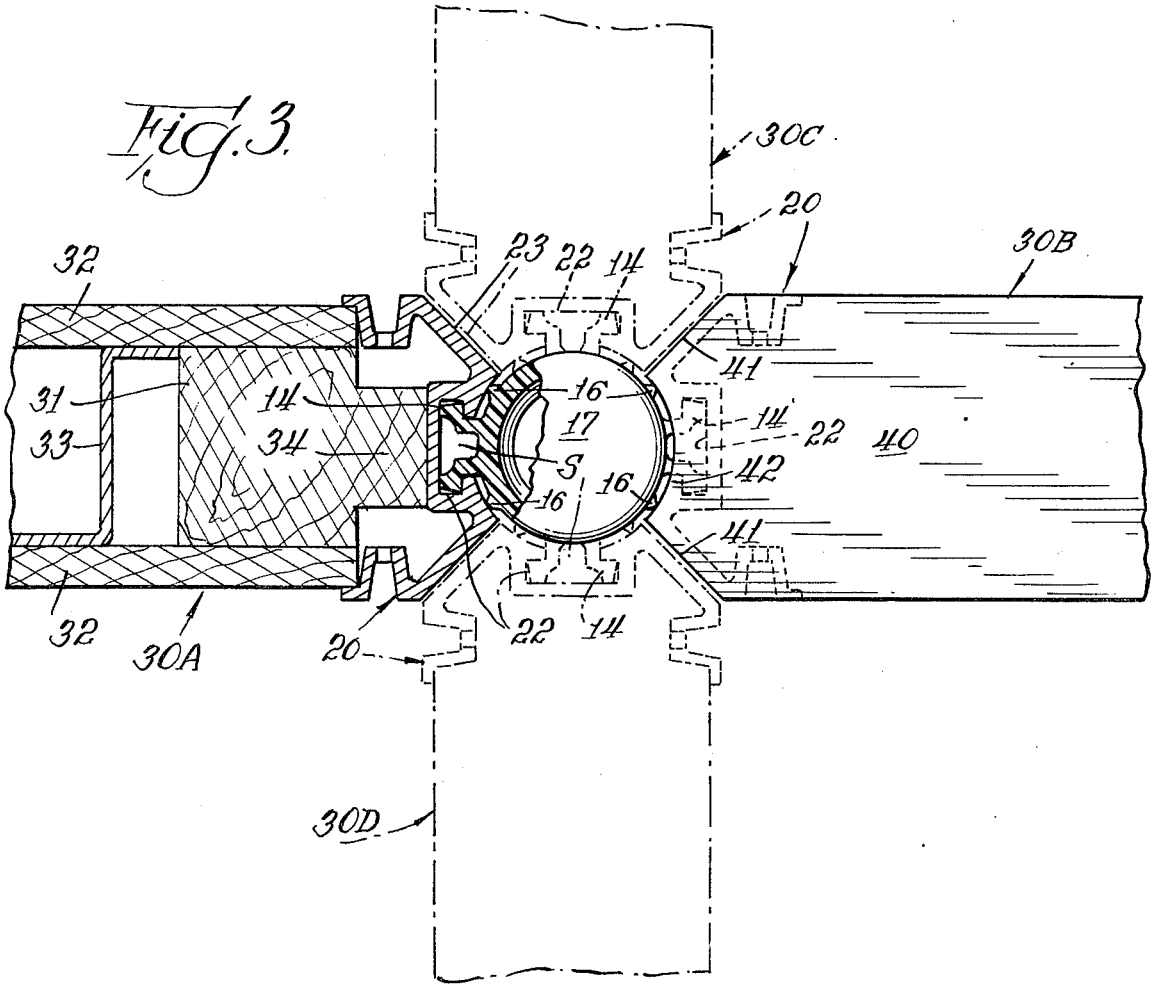
FIG. 3 is a plan view in partial section showing panels attached to the column.

The angle subtended by the arcuate portion 21 and formed by the side portions 23 depends on the number of panels desired to be attachable to the column 10. If a maximum of only two panels are to be attached, then the angle can be as great as 180° and, when the two panels are attached, the sides 23 of one astragal then abut the sides 23 of the other astragal and the angle through which one panel could be rotated with respect to the other is zero. If a maximum of four panels are to be attached, then the angle can be a maximum of 90° and, when the four panels are attached, the sides 23 of one astragal then abut the sides 23 of the adjacent astragals with the result that a neat corner is formed and the column 10 completely hidden. This is best seen in FIG. 3 where panels 30*a*, 30*b*, 30*c*, and 30*d* are attached with the sides 23 of one astragal abutting the sides 23 of the adjacent astragal. If only two panels are attached, for example, panels 30*a* and 30*b* in FIG. 2, the one panel 30*b* can be rotated about the column with respect to 30*a* through an angle of 180°. It can be rotated to position shown in FIG. 2 and a third panel added, then the panels rotated to juxtaposition and a fourth panel added.

It will thus be seen that the angles subtended by the arcuate portion 21 and the sides 23 are determined by the formula 360/X° where X is a small integer of at least 2. Where X is 2, two panels can be attached. Where X is 3, two or three panels can be attached. Where X is 4, two, three, or four panels can be attached, and so on. Ordinarily, it will not be desirable to provide for the attachment of more than about six panels, because otherwise the angle between the panels becomes too small for practical purposes.

In assembling the panels, the bottom segment is inserted into the astragal of one panel, for example, as shown in FIG. 1, and the second segment attached in the same manner. Then, two segments can be attached to the other panel, then two to the first, two to the second, and so on, until the last segment is in place. The top 40 for the panels can then be put on the panels and the panel assembly is ready for use. Load supporting and leveling devices 50 may be attached to the bottom of the panels. These comprise standard construction of a female screw 51 fastened into the bottom stud of the panel and a male screw 52 attached to level cup 54 having therein a plastic or rubber caster 55. The screw 52 may be provided with the lock-nut 53 for locking the support 50 in position after it has been adjusted.

Now, if another panel is desired to be added, the tops 40 are taken off and the appropriate panels raised high enough to disengage the member 14 of the bottom segment 10 which is then rotated to expose the member 14. The panel then is dropped back into position and a top segment 10 is removed and rotated so that the T-shaped member 14 is on the same side as the T-shaped member of the bottom segment. A third panel is then inserted over these T-shaped members 14 and that panel is thereby affixed to the column. It will be observed that each panel may be attached to more than one segment 11 but no two panels are attached to the same segment. Thus, when the segmented column 10 is intact, the panels may be rotated freely to any desired position. When a fourth panel is desired to be added a like procedure is followed, raising the panel as necessary to free a panel-connecting means and then raising the top members of the column as necessary to free another one.

FIG. 9 illustrates how the column would look where four panels are attached. Thus, counting from the bottom, the first, fifth and ninth segments would be attached to the right hand panel, the third and seventh segments to the left hand panel, the second, sixth and tenth segments to the front projecting panel, and the fourth and eighth segments to the back projecting panel.

While in FIG. 4 the tongue 36 is shown cut off several inches above the bottom of the panel, it is to be understood that it may not be necessary to cut it off that much since it is only cut off for the purpose of allowing the attachment of the bottom support 45.

The segment 11 may have longitudinal pointed ribs 16 extending along elements thereof and spaced to the sides of the T-shaped panel connector 14 so that they ride on the arcuate surfaces 21. This gives a point contact between the column and the astragal so that relative axial movement of the two is facilitated.

The astragals, advantageously, are made of aluminum and are extruded. This is made possible by the symmetrical design. The segments 11 are, advantageously, made of plastic such as polyethylene or polypropylene or nylon 66 and may be cast, machined, or cut and machined from extruded cylinders. The panels may be of wood or of any other suitable building construction material. Advantageously, they are laminated on a hollow core or frame in order to reduce weight and conserve material.

To adjust for panels of different heights, segments of different lengths can be provided. If 3, 4, and 5 inch segments are available, adjustment to one inch can be made. Alternatively, the top segment can be cut off as, for example, along line *a*, FIG. 6, or the bottom segment cut off along any of lines *b, c, d, e,* and *f*.

The panel connector 14 is cut off at 19 to accommodate the removable top 40. If the top segment is cut off for height adjustment, the panel connector 14 should be cut down an equal distance. Also, a differently shaped cap is required as the top segment will then have no female taper 12.

The shoulder 15 is adapted to rest on the top of the segment 11 and prevents jamming or binding of the male taper 13 in the female taper 12. Free rotation of each segment with respect to each adjacent segment is thus assured.

It is to be understood that the invention is not to be limited to the exact details of operation or structure shown and described as obvious modifications and equivalents will be apparent to one skilled in the art.

I claim:

1. A panel assembly which comprises (1) panels;

(2) a segmented cylindrical column the segments of which are individually rotatable;

(3) panel connecting means on each segment;

(4) segment connecting means on each panel;

(5) said panels being connected to different segments; and (6) said segment connecting means having an arcuate portion conforming to the curvature of said column, which subtends an angle of 360/X° wherein X is a small integer of at least 2, and side portions extending out radially from the sides of said arcuate portion and forming an angle between them of 360/X°, whereby up to X panels can be attached to said column and when only two panels are attached, one can be rotated with respect to the other through an angle of 360 (1−2/X) degrees.

2. The panel assembly of claim 1, in which the panels have load supporting means and the segmented column does not.

3. The panel assembly of claim 1, in which the panel connecting means and the segment connecting means are complementary male and female members adapted to dovetail one into the other.

4. The panel assembly of claim 1, in which the segments are hollow cylinders having a female taper at one end and a male taper at the other, the male taper of each segment being complementary to the female taper of each other segment, whereby the column can be built up by inserting the male taper of one segment into the female taper of the other.

5. The panel assembly of claim 4, in which the panel-connecting means is a T-shaped member the stem of which is attached to an element of the segment and the segment connecting means is a complementary undercut slot.

6. The panel assembly of claim 5, in which the undercut slot has means adjacent the bottom thereof for limiting the downward movement of the bottom segment.

7. The panel assembly of claim 5, in which the segment connecting means is attached to the panel by screws in the undercut slot and the T-shaped member has a central channel to accomodate the heads of the screws.

8. The panel assembly of claim 1, in which the outer ends of the radially extending side portions of the segment connecting means extend back toward the panel to which the segment connecting means is attached and provide portions bridging said outer ends and the side ends of said panel.

9. The panel assembly of claim 8, in which the portion bridging said outer ends and said side ends is provided with fixture attaching means.

10. The panel assembly of claim 9, in which the fixture attaching means is a vertical channel having fixture-support attaching slots at the base of the channel.

11. The panel assembly of claim 9, in which the segment connecting means and the fixture-support attaching means comprise a unitary extrusion affixed to the end of the panel.

12. The panel assembly of claim 11, in which the angle subtended by said arcuate portion of the segment connector means is 90° whereby up to four panels can be attached to said column and when only two panels are so attached, one can be rotated with respect to the other through an angle of 180°.

13. The panel assembly of claim 12, in which the panel connecting means and the segment connecting means are complementary male and female members adapted to dovetail one into the other.

14. The panel assembly of claim 13, in which the segments are hollow cylinders having a female taper at one end and a male taper at the other, the male taper of each segment being complementary to the female taper of each other segment, whereby the column can be built up by inserting the male taper of one segment into the female taper of the other.

15. The panel assembly of claim 14, in which the panel-connecting means is a T-shaped member the stem of which is attached to the segment along an element thereof and the segment connecting means is a complementary undercut slot.

16. The panel assembly of claim 15, in which the undercut slot has means adjacent the bottom thereof for limiting the downward movement of the bottom segment.

17. The panel assembly of claim 16, in which the segment connecting means is attached to the panel by screws in the undercut slot and the T-shaped member has a central channel to accomodate the heads of the screws.

18. The panel assembly of claim 17, in which the panels have load supporting means and the segmented column does not.

19. A segment adapted to form a column for uniting panels for forming room dividers which comprises a hollow cylinder, one end of which has a female taper and the other end of which has a complementary male taper and panel connecting means attached to said cylinder along an element thereof.

20. The segment of claim 19, in which the angle of the taper is between about 10 and about 20°.

21. A segment according to claim 19, in which the panel connecting means is a T-shaped member having the stem of the "T" attached to the cylinder along an element thereof.

22. The segment of claim 21, in which the angle of the taper is between about 10 and about 20°.

23. A column for uniting panels for forming room dividers which comprises a plurality of stacked hollow cylinders, one end of which has a female taper and the other end of which has a complementary male taper and panel connecting means attached to said cylinder along an element thereof.

24. The column of claim 23, in which the angle of the taper is between about 10 and about 20°.

25. The column of claim 23, in which the panel connecting means is a T-shaped member having the stem of the "T" attached to the cylinder along an element thereof.

26. The column of claim 25, in which the angle of the taper is between about 10 and about 20°.

27. An astragal for panels adapted for forming room dividers which comprise an extrusion having (1) a longitudinal concave cylindrical surface subtending an angle of 360/X degrees, where X is a small integer of at least 2;

(2) longitudinal sides extending radially outwardly from said concave surface and forming with each other an angle of 360/X degrees; and (3) means for attaching said astragal to a panel.

28. The astragal of claim 27, in which the extrusion has a longitudinal channel T-shaped in cross-section with the step of the T-shaped channel opening along the middle of the longitudinal concave cylindrical surface.

29. The astragal of claim 27, in which X is 4.

30. The astragal of claim 29, in which the extrusion has portions adapted to bridge the outer ends of said longitudinal sides and the sides of a panel.

31. The astragal of claim 30, in which the bridging portions have fixture attaching means provided thereon.

32. The astragal of claim 31, in which the fixture attaching means is a vertical channel having fixturesupport attaching slots at the base of the channel.

33. A panel assembly which comprises (1) panels;

(2) a segmented cylindrical column the segments of which are individually rotatable;

(3) panel connecting means on each segment;

(4) segment connecting means on each panel;

(5) said panels being connected to different segments; and (6) each segment being a hollow cylinder having, at one end, a female taper and, at the other end, a complementary male taper, whereby the column is formed by the insertion of a male taper of one segment into the female taper of another.

34. The panel assembly of claim 33, in which the panel connecting means is a T-shaped member having the stem of the "T" attached to the cylinder along an element thereof.

35. The panel assembly of claim 34, in which the segment connecting means is an astragal having a longitudinal slot complementary in shape to said T-shaped member.

36. The panel assembly of claim 35, in which the astragal has a longitudinal concave portion conforming to the curvature of the segmented column which subtends an angle of 90°, sides sloping radially backwardly from the side edges of said arcuate portions and forming an angle of 90°, bridging portions extending backwardly from the outer edges of said sides into abuttment with the edges of the panels, and fixture attaching means on said bridging portions.

37. The panel assembly of claim 36, in which the fixture attaching means comprises longitudinal channels having fixture-support engaging slots at the bottom thereof.

38. A segment adapted to form a column for uniting panels for forming room dividers which comprises a hollow cylinder, one end of which has a female taper and the other end of which has a complementary male taper, and panel connecting means attached to said cyliner along an element thereof, in which the hollow cylinder has an inner taper tapering outwardly towards the end having the female taper.

39. The segment of claim 38, in which the angle of the inner taper is less than the angle of the taper of the female taper.

40. A segment adapted to form a column for uniting panels for forming room dividers which comprises a hollow cylinder, one end of which has a female taper and the other end of which has a complementary male taper, and panel connecting means attached to said cylinder along an element thereof, in which the hollow cylinder has longitudinally extending ribs on each side of the panel connecting means.

41. A segment adapted to form a column for uniting panels for forming room dividers which comprises a a hollow cylinder, one end of which has a female taper and the other end of which has a complementary male taper, and panel connecting means attached to said cylinder along an element thereof, in which the panel connecting means is a T-shaped member having the stem of the "T" attached to the cylinder along an element thereof, and in which the hollow cylinder has longitudinally extending ribs on each side of the panel connecting means.

42. A column for uniting panels for forming room dividers which comprises a plurality of stacked hollow cylinders, one end of which has a female taper and the other end of which has a complementary male taper, and panel connecting means attached to said cylinder along an element thereof, in which each of said hollow cylinders has longitudinally extending ribs on each side of the panel connecting means.

43. A column for uniting panels for forming room dividers which comprises a plurality of stacked hollow cylinders, one end of which has a female taper and the other end of which has a complementary male taper, and panel connecting means attached to said cylinder along an element thereof, in which the panel connecting means is a T-shaped member having the step of the "T" attached to the cylinder along an element thereof, and in which each of said hollow cylinders has longitudinally extending ribs on each side of the panel connecting means.

44. A column for uniting panels for forming room dividers which comprises a plurality of stacked hollow cylinders, one end of which has a female taper and the other end of which has a complementary male taper and panel connecting means attached to said cylinder along an element thereof, in which the panel connecting means is a T-shaped member having the stem of the "T" attached to the cylinder along an element thereof, in which the angle of the taper is between about 10 and about 20°, and in which each hollow cylinder has an inner taper tapering outwardly towards the end having the female taper and in which the angle of the inner taper is less than the angle of the taper of the female taper.

* * * * *

UNITED STATES PATENT AND TRADEMARK OFFICE

CERTIFICATE OF CORRECTION

PATENT NO. : 4,129,163

DATED : December 12, 1978

INVENTOR(S) : Johnson

It is certified that error appears in the above-identified patent and that said Letters Patent are hereby corrected as shown below:

Col. 3, line 6; "panels" should read -- panel --
Col. 6, line 9; "9" should read -- 10 --
Col. 7, lines 28 & 29 "fixturesup-port" (incorrectly hyphenated) should read -- fixture-support --
Col. 8, line 6; "cyliner" should read -- cylinder --

Col. 8, line 45; "step" should read -- stem --

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*